US009421786B2

(12) United States Patent
Ohnishi

(10) Patent No.: US 9,421,786 B2
(45) Date of Patent: Aug. 23, 2016

(54) DAMPER DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/437,835

(22) PCT Filed: Oct. 30, 2013

(86) PCT No.: PCT/JP2013/079416

§ 371 (c)(1),
(2) Date: Apr. 23, 2015

(87) PCT Pub. No.: WO2014/073433

PCT Pub. Date: May 15, 2014

(65) Prior Publication Data

US 2015/0273850 A1 Oct. 1, 2015

(30) Foreign Application Priority Data

Nov. 7, 2012 (JP) ..... 2012-245857

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC ..... B41J 2/17596
USPC ..... 347/94
See application file for complete search history.

(56) References Cited

U.S. PATENT DOCUMENTS

2008/0151021 A1* 6/2008 Miyazawa ..... B41J 2/17503 347/86

2011/0221835 A1* 9/2011 Maruyama ..... B41J 2/17556 347/85

(Continued)

FOREIGN PATENT DOCUMENTS

JP 09-193414 7/1997
JP 2003-311992 11/2003

(Continued)

OTHER PUBLICATIONS

"International Search Report (Form PCT/ISA/210)", mailed on Nov. 26, 2013, with English translation thereof, pp. 1-4, in which five of the listed references (JP2004-209665, JP2003-311992, JP09-193414, JP2007-144887 and JP2003-312016) were cited.

(Continued)

*Primary Examiner* — Manish S Shah
*Assistant Examiner* — Roger W Pisha, II
(74) *Attorney, Agent, or Firm* — Jianq Chyun IP Office

(57) ABSTRACT

A damper device that supplies ink supplied from a tank to a recording head while suppressing pressure fluctuation, and has a head-side chamber communicating with the recording head; a tank-side chamber communicating with the tank; a communicating passage communicating the head-side chamber and the tank-side chamber; a valve for opening or closing the communicating passage; a spring that biases the valve in a direction along which the valve closes the communicating passage; a pressure receiving plate that receives air pressure, and changes volume of the head-side chamber according to a change in a position of itself; a rod member arranged between the valve and the pressure receiving plate, and configured to transmit force received from one of the valve and the pressure receiving plate to the other thereof; and a bellows unit that supports the pressure receiving plate so that the position of the pressure receiving plate is changeable.

6 Claims, 18 Drawing Sheets

(56) References Cited

U.S. PATENT DOCUMENTS

| | | | | |
|---|---|---|---|---|
| 2012/0194608 | A1* | 8/2012 | Matsumoto | B41J 2/16532 347/30 |
| 2012/0194620 | A1* | 8/2012 | Matsumoto | B41J 2/16523 347/85 |

FOREIGN PATENT DOCUMENTS

| | | |
|---|---|---|
| JP | 2003-312016 | 11/2003 |
| JP | 2004-209665 | 7/2004 |
| JP | 3606282 | 1/2005 |
| JP | 2007-144887 | 6/2007 |

OTHER PUBLICATIONS

"1st Office Action of China Counterpart Application", issued on Nov. 20, 2015, p. 1-p. 13, with English translation thereof.

* cited by examiner

DAMPER DEVICE

CROSS-REFERENCE TO RELATED APPLICATION

This application is a 371 application of an international PCT application serial no. PCT/JP2013/079416, filed on Oct. 30, 2013, which claims the priority benefit of Japan application no. 2012-245857, filed on Nov. 7, 2012. The entirety of each of the above-mentioned patent applications is hereby incorporated by reference herein and made a part of this specification.

TECHNICAL FIELD

The present invention relates to a damper device that is provided in an inkjet printer including a recording head that discharges ink and a tank that supplies the ink, and the damper device is configured to supply the ink supplied from the tank to the recording head while suppressing pressure fluctuation.

BACKGROUND ART

In a conventional damper device, a valve unit is known (see Patent Document 1). The valve unit is formed to includes a pressure chamber as a head-side chamber communicating with a recording head, an ink supplying chamber as a tank-side chamber communicating with an ink cartridge as a tank, and an ink supplying hole as a communicating passage communicating the pressure chamber and the ink supplying chamber, and the valve unit further includes a plate-shaped member as a valve for opening or closing the ink supplying hole, a sealing spring as a spring biasing the plate-shaped member in a direction to close the ink supplying hole by the plate-shaped member, a pressure receiving plate as a pressure receiving unit that receives air pressure, and changes a volume of the pressure chamber according to a change in its own position, a rod member as a force transmitting unit that is arranged between the plate-shaped member and the pressure receiving plate, and transmits force received from one of the plate-shaped member and the pressure receiving plate to the other thereof, and a flexible film member that extends in a direction that is vertical to a direction along which the plate-shaped member opens or closes the ink supplying hole, and supports the pressure receiving plate so that a position of the pressure receiving plate is changeable.

PRIOR ART DOCUMENT

Patent Document

Patent Document 1: JP 3606282 B

SUMMARY OF THE INVENTION

Problem to be Solved by the Invention

However, in a conventional damper device, since the pressure receiving unit receives force necessary for the valve to open the communicating passage by the air pressure, an area of the pressure receiving unit in a direction that is vertical to the direction along which the valve opens or closes the communicating passage must be made large. Further, in the conventional damper device, a width in the direction that is vertical to the direction along which the valve opens or closes the communicating passage must be made large in a deformable portion within the flexible film member, which is supporting the pressure receiving unit to obtain the change in the position of the pressure receiving unit needed for the valve to open the communicating passage. Accordingly, the conventional damper device has a problem that its size in the direction that is vertical to the direction along which the valve opens or closes the communicating passage becomes large.

Thus, the present invention aims to provide a damper device that can make the size in the direction that is vertical to the direction along which the valve opens or closes the communicating passage smaller than in the conventional configurations.

Solutions to the Problem

A damper device of the present invention is provided in an inkjet printer including a recording head that discharges ink, and a tank that supplies the ink, is configured to supply the ink supplied from the tank to the recording head while suppressing pressure fluctuation, and is characteristic in including: a head-side chamber communicating with the recording head; a tank-side chamber communicating with the tank; a communicating passage that communicates the head-side chamber and the tank-side chamber; a valve configured to open or close the communicating passage; a biasing member that biases the valve in a direction along which the valve closes the communicating passage; a pressure receiving unit that receives air pressure, and changes a volume of the head-side chamber according to a change in a position of itself; a force transmitting unit arranged between the valve and the pressure receiving unit, and configured to transmit force received from one of the valve and the pressure receiving unit to the other thereof; and a bellows unit that supports the pressure receiving unit so that the position of the pressure receiving unit is changeable.

According to this configuration, the damper device of the present invention does not change the position of the pressure receiving unit by deformation of the flexible film member itself as in the conventional configuration, but changes the position of the pressure receiving unit by folding deformation of the bellows unit; thus, the conventional flexible film member that extends in the direction that is vertical to the direction along which the valve opens or closes the communicating passage and supports the pressure receiving unit so that the position of the pressure receiving unit is changeable is no longer necessary. Accordingly, the damper device of the present invention can make its size in the direction that is vertical to the direction along which the valve opens or closes the communicating passage smaller than the conventional configuration.

Further, in the damper device of the present invention, the bellows unit may include a plurality of plates, and a bendable connecting unit that connects the plates, and the plates and the bendable connecting unit may be formed as one component made of synthetic resin.

According to this configuration, in the damper device of the present invention, the plates and the bendable connecting unit can be manufactured by integral formation of the synthetic resin. Accordingly, the damper device of the present invention can reduce manufacturing cost, for example.

Further, in the damper device of the present invention, the pressure receiving unit may be supported rotatably.

According to this configuration, in the damper device of the present invention, in the situation where the valve transmits force to the pressure receiving unit via the force transmitting unit at a farther side from a rotation center of the pressure receiving unit, since the moving amount of the valve relative to decreasing amount of the ink in the head-side chamber can be increased compared to the configuration in which an entirety of the pressure receiving unit moves in the direction along which the valve opens or closes the communicating passage, pressure fluctuation of the ink in the head-side chamber can be made less. Further, in the damper device of the present invention, in the situation where the valve transmits force to the pressure receiving unit via the force transmitting unit in a vicinity of the rotation center of the pressure receiving unit, even if the size of the pressure receiving unit is made smaller in the direction that is vertical to the direction along which the valve opens or closes the communicating passage, the force needed for the valve to open the communicating passage can be obtained by the pressure receiving unit by air pressure, as compared to the configuration in which the entirety of the pressure receiving unit moves in the direction along which the valve opens or closes the communicating passage.

Further, in the damper device of the present invention, the pressure receiving unit and a supporting unit rotatably supporting the pressure receiving unit may be formed as one component made of synthetic resin.

According to this configuration, in the damper device of the present invention, the pressure receiving unit and the supporting unit can be manufactured by the integral formation of the synthetic resin. Accordingly, the damper device of the present invention can reduce manufacturing cost, for example.

Effects of the Invention

The damper device of the present invention can make its size in the direction that is vertical to the direction along which the valve opens or closes the communicating passage smaller than the conventional configuration.

EMBODIMENTS OF THE INVENTION

Hereinbelow, embodiments of the present invention will be described with reference to the drawings.

First Embodiment

Firstly, a configuration of an inkjet printer according to the present embodiment will be described.

Figure 1:
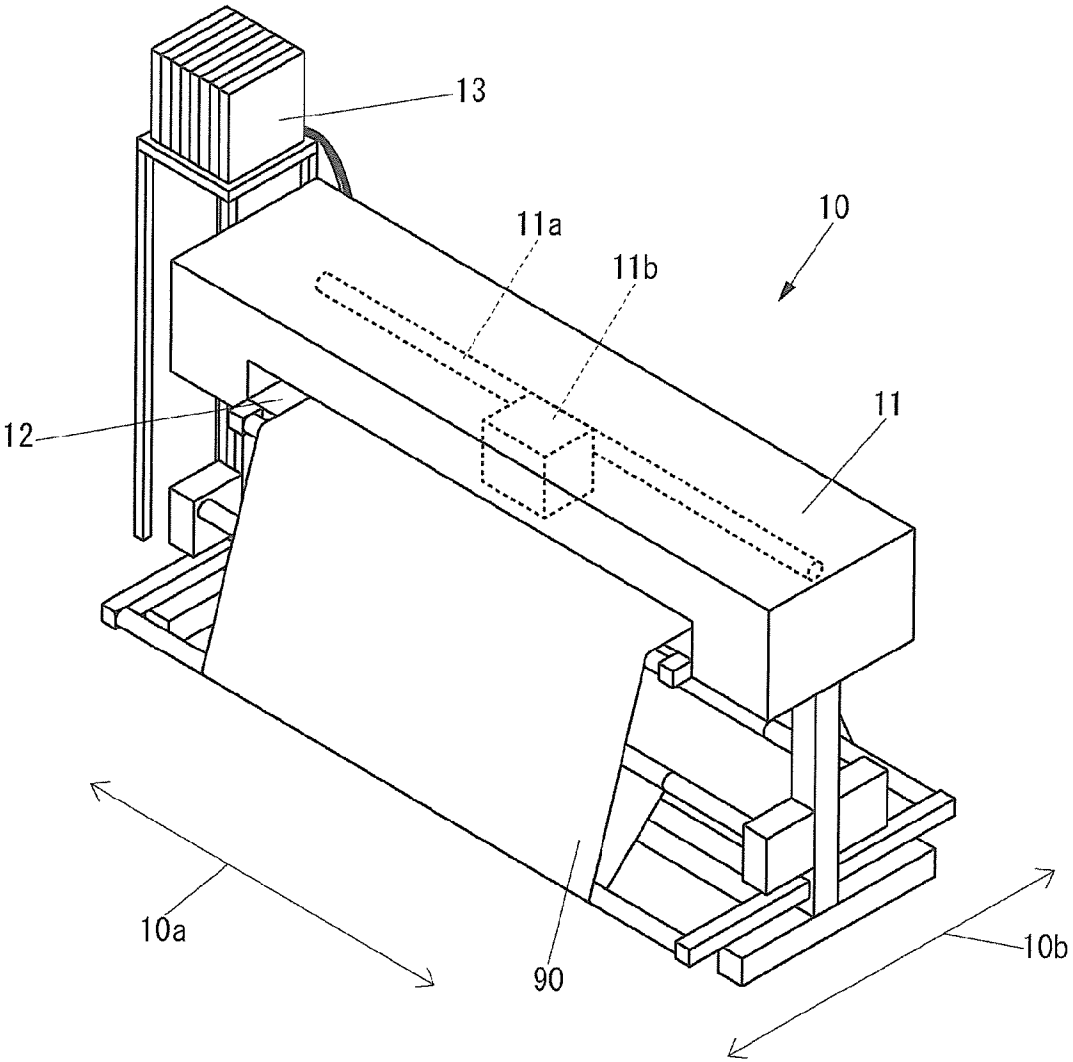
FIG. 1 is a perspective diagram of an inkjet printer according to a first embodiment of the present invention.

FIG. 1 is a perspective diagram of an inkjet printer 10 according to the present embodiment.

As shown in FIG. 1, the inkjet printer 10 includes a main body 11 extending in a main scanning direction shown by an arrow 10*a*, a transfer device 12 that transfers recording medium 90 such as paper, and a tank 13 that supplies ink.

The main body 11 includes a guide rail 11*a* extending in the main scanning direction shown by the arrow 10*a*, and a carriage 11*b* supported on the guide rail 11*a* so as to be movable in the main scanning direction shown by the arrow 10*a*.

The transfer device 12 is a device that transfers the recording medium 90 in a sub scanning direction shown by an arrow 10*b* relative to a later-described recording head 11*c* of the main body 11.

Figure 2:
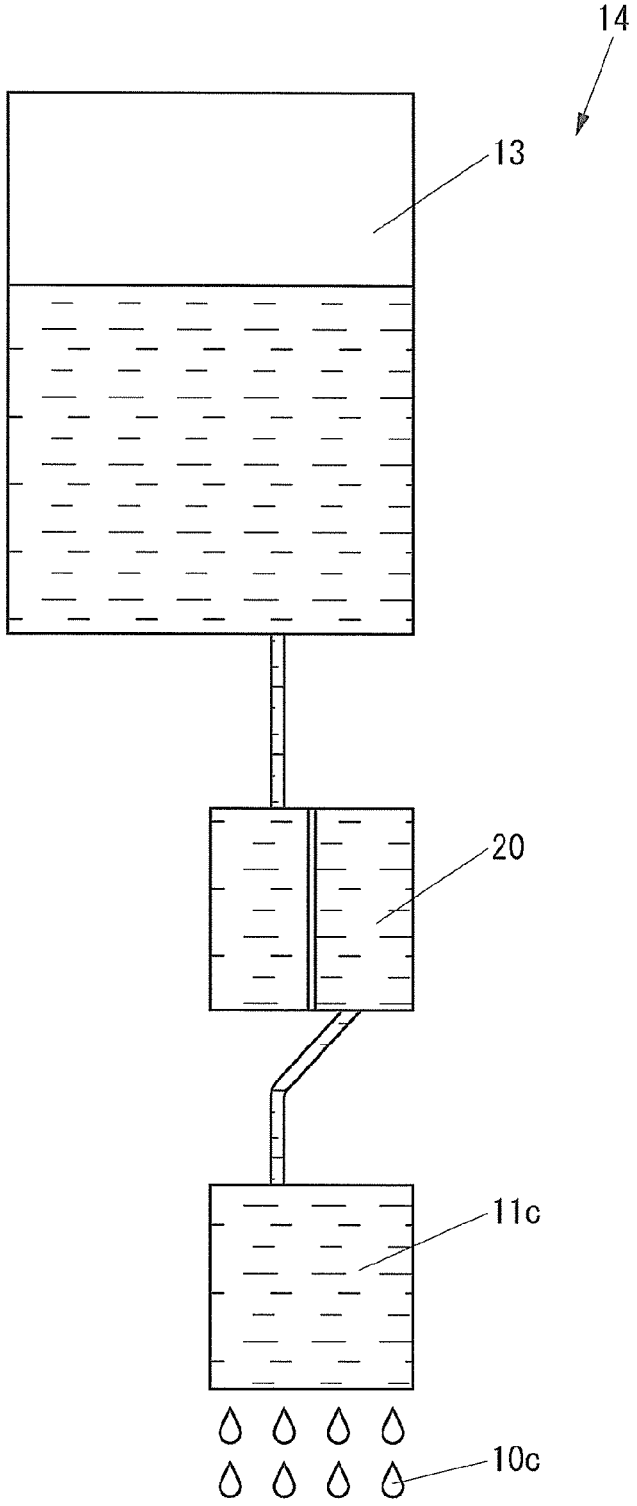
FIG. 2 is a schematic diagram of an ink supplying system of the inkjet printer shown in FIG. 1.

FIG. 2 is a schematic diagram of an ink supplying system 14 of the inkjet printer 10.

As shown in FIG. 2, the ink supplying system 14 includes the recording head 11*c* that discharges ink 10*c* onto the recording medium 90, the aforementioned tank 13 that supplies the ink 10*c*, and a damper device 20 that supplies the ink 10*c* supplied from the tank 13 to the recording head 11*c* while suppressing pressure fluctuation.

The recording head 11*c* and the damper device 20 are mounted on a carriage 11*b*.

The inkjet printer 10 includes the recording head 11*c*, the tank 13, and the damper device 20 at least for each of types of the ink 10*c*. The types of the ink 10*c* differ depending on the color type, such as cyan, magenta, yellow, black, and the like.

The inkjet printer 10 shown in FIG. 1 is a device that causes printing by the recording head 11*c* in the main scanning direction to be executed by moving the recording head 11*c* in the main scanning direction using the carriage 11*b* relative to the recording medium 90 that does not move in the main scanning direction shown by the arrow 10*a*, and discharging the ink 10*c* from nozzles of the recording head 11*c* to the recording medium 90. Further, the inkjet printer 10 is a device that changes a position of the recording head 11*c* in the sub scanning direction relative to the recording medium 90 each time the printing in the main scanning direction ends, by transferring the recording medium 90 in the sub scanning direction using the transfer device 12 relative to the recording head 11*c* that does not move in the sub scanning direction shown by the arrow 10*b*.

Figure 3:
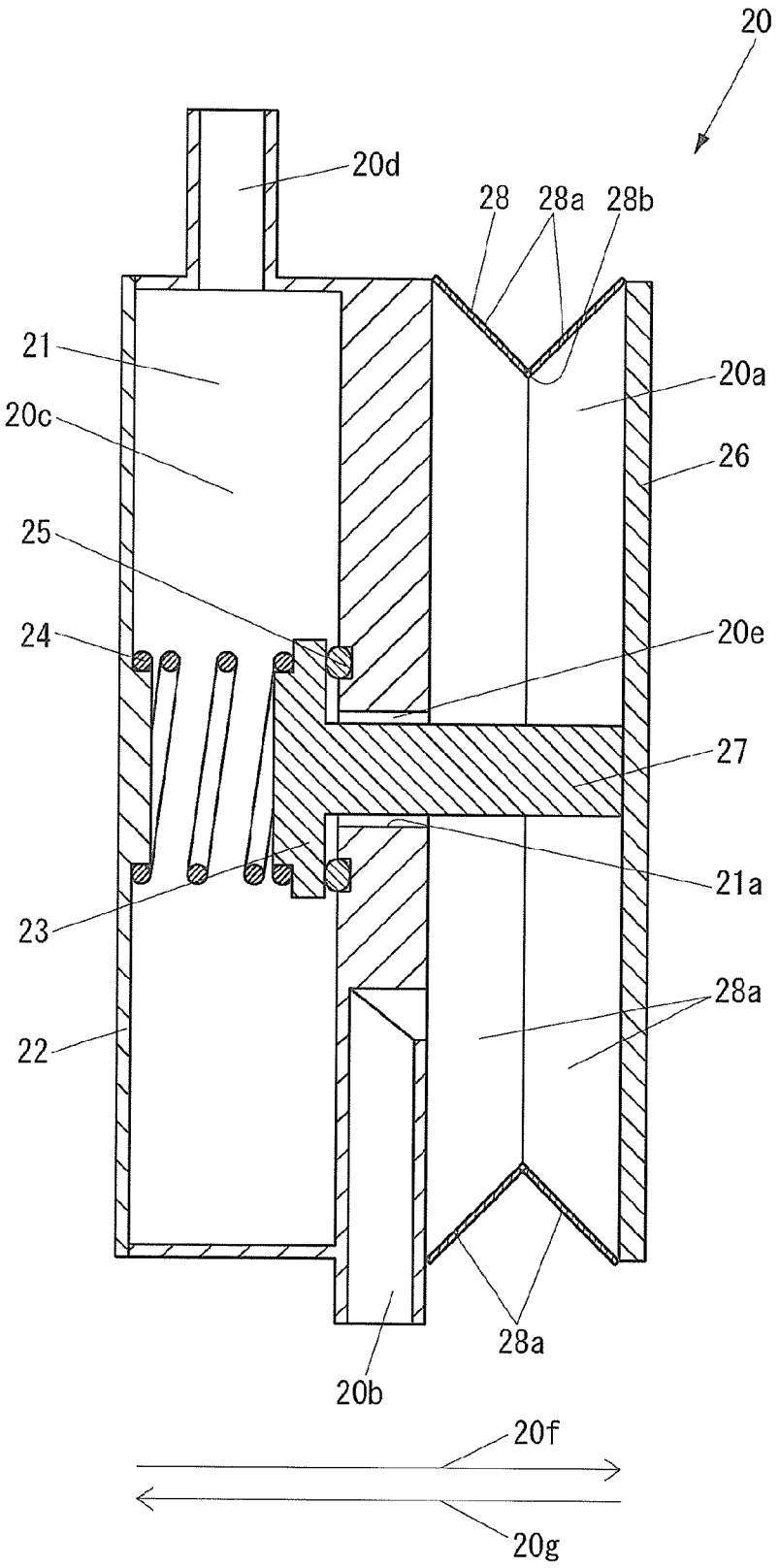
FIG. 3 is a front side cross sectional diagram of a damper device shown in FIG. 2 in the situation where a valve is closing a communicating passage.

FIG. 3 is a front side cross sectional diagram of the damper device 20 in the situation where a valve 23 is closing a communicating passage 20*e*.

As shown in FIG. 3, the damper device 20 includes a head-side chamber 20*a* that communicates with the recording head 11*c*, a passage 20*b* configuring a part of a passage communicating the recording head 11*c* and the head-side chamber 20*a*, a tank-side chamber 20*c* that communicates with the tank 13, a passage 20*d* configuring a part of a passage communicating the tank 13 and the tank-side chamber 20*c*, and a communicating passage 20*e* that communicates the head-side chamber 20*a* and the tank-side chamber 20*c*.

Figure 4:
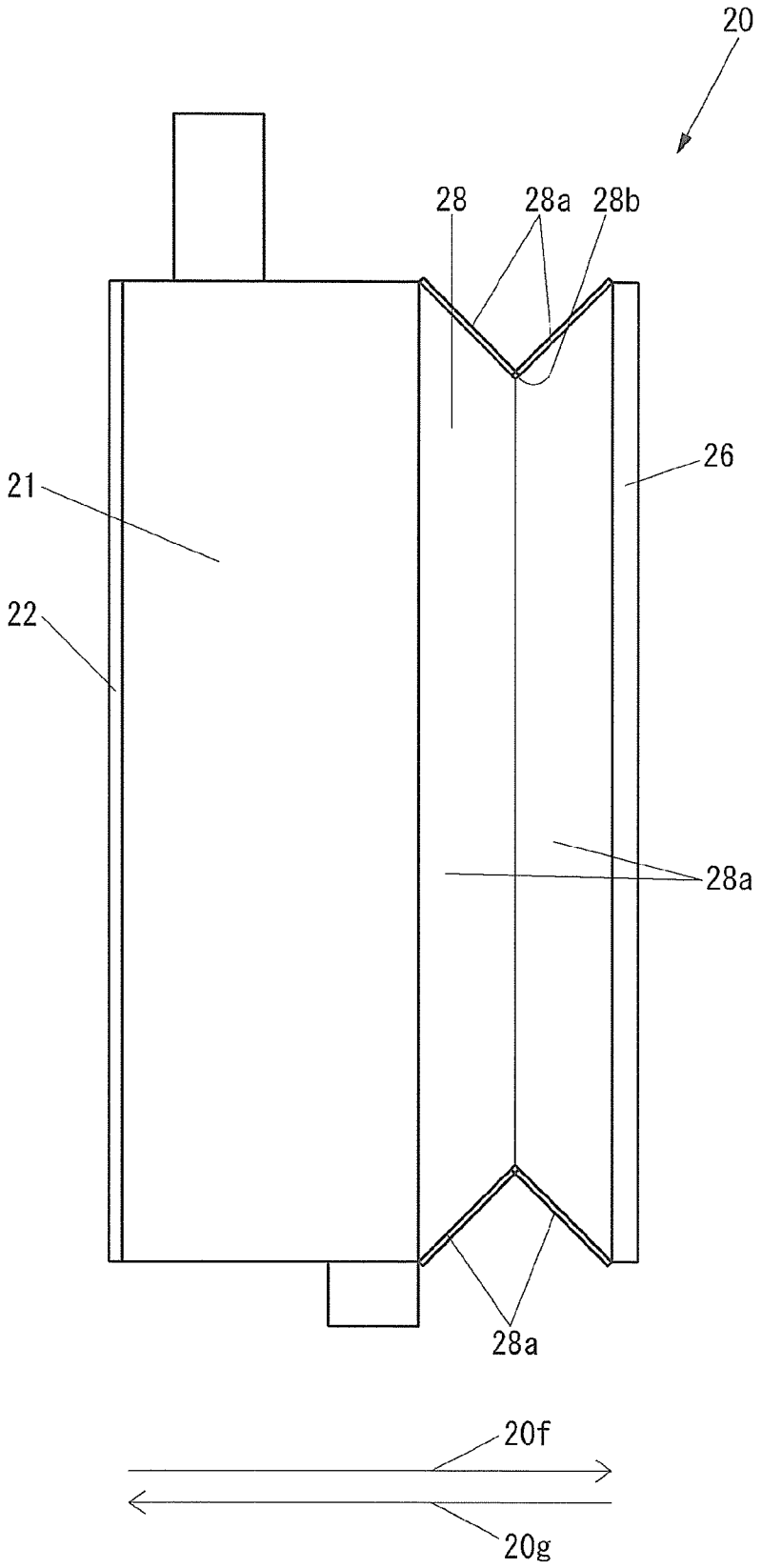
FIG. 4 is a front side diagram of the damper device shown in FIG. 2 in the situation where the valve is closing the communicating passage.
Figure 5:
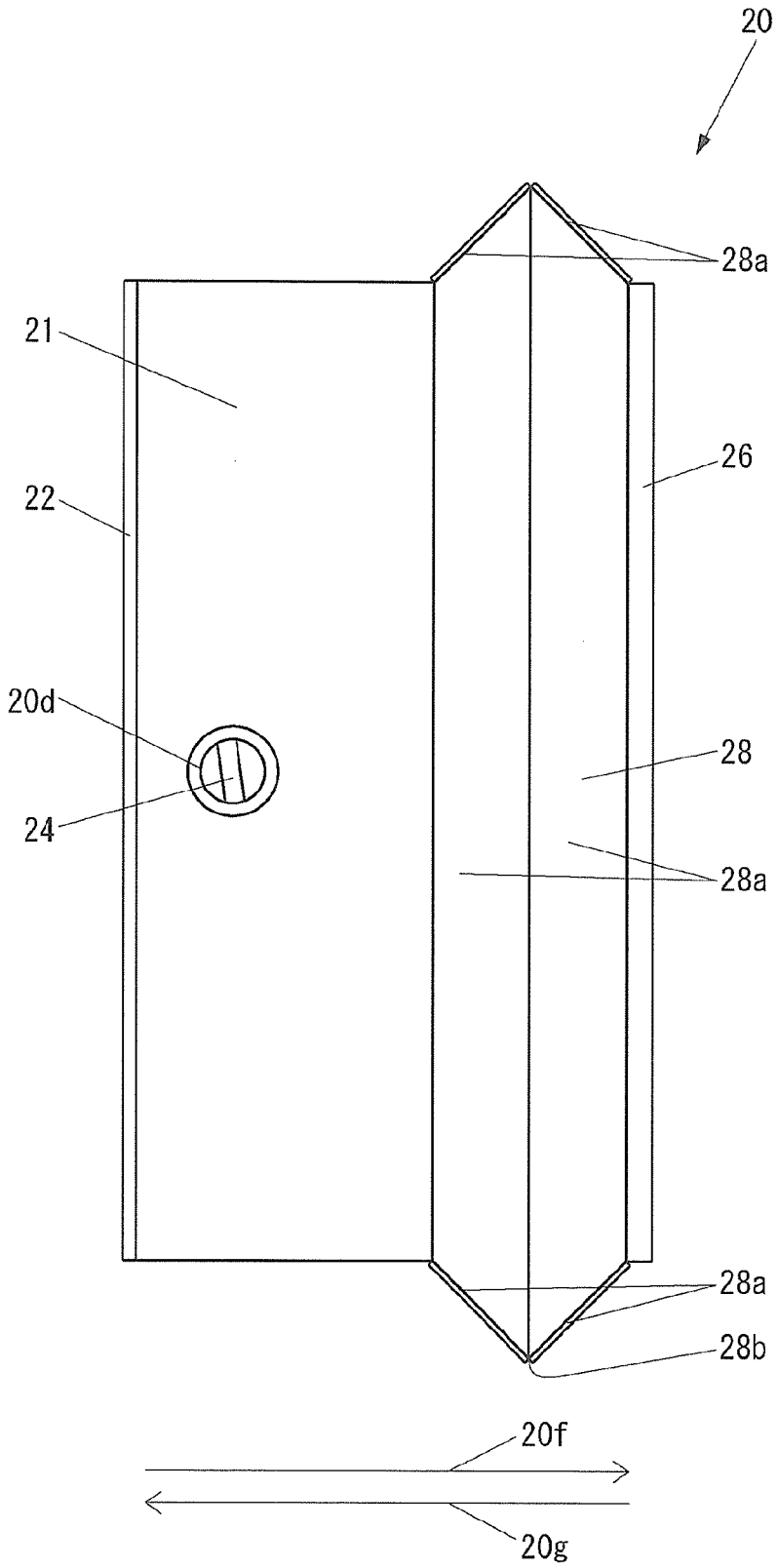
FIG. 5 is a planar diagram of the damper device shown in FIG. 2 in the situation where the valve is closing the communicating passage.

FIG. 4 is a front side diagram of the damper device 20 in the situation where the valve 23 is closing the communicating passage 20*e*. FIG. 5 is a planar diagram of the damper device 20 in the situation where the valve 23 is closing the communicating passage 20*e*.

As shown in FIG. 3 to FIG. 5, the damper device 20 includes a case 21 in which the passage 20*b* and the passage 20*d* are formed, a cover 22 fixed to the case 21, the valve 23 for opening or closing the communicating passage 20*e*, a spring 24 as a biasing member that is fixed to the cover 22 and the valve 23, and biases the valve 23 in a direction shown by arrow 20*f* along which the valve 23 closes the communicating passage 20*e*, an o-ring 25 that is fixed to the case 21 and configured to prevent leakage of the ink 10*c* between the case 21 and the valve 23 in a situation where the valve 23 is closing the communicating passage 20*e*, a pressure receiving plate 26 as a pressure receiving unit that receives air pressure, and changes a volume of the head-side chamber 20*a* according to a change in the position of itself, a rod member 27 as a force transmitting unit that is arranged between the valve 23 and the pressure receiving plate 26 and configured to transmit force received from one of the valve 23 and the pressure receiving plate 26 to the other thereof, and a bellows unit 28 that supports the pressure receiving plate 26 so that the position of the pressure receiving plate 26 is changeable.

The head-side chamber 20*a* is formed by the case 21, the pressure receiving plate 26, and the bellows unit 28.

The tank-side chamber 20*c* is formed by the case 21 and the cover 22.

The communicating passage 20*e* is formed by the case 21 and the rod member 27.

The case 21 has a hole 21*a* through which the rod member 27 is to be inserted. The case 21 is formed by synthetic resin such as polyethylene.

The cover 22 is formed by synthetic resin such as polyethylene. The cover 22 is fixed to the case 21 by an adhesive.

The valve 23 is formed together with the rod member 27 as one component made of synthetic resin such as polyethylene.

The pressure receiving plate 26 is formed by synthetic resin such as polyethylene. The pressure receiving plate 26 does not have flexibility.

Figure 6:
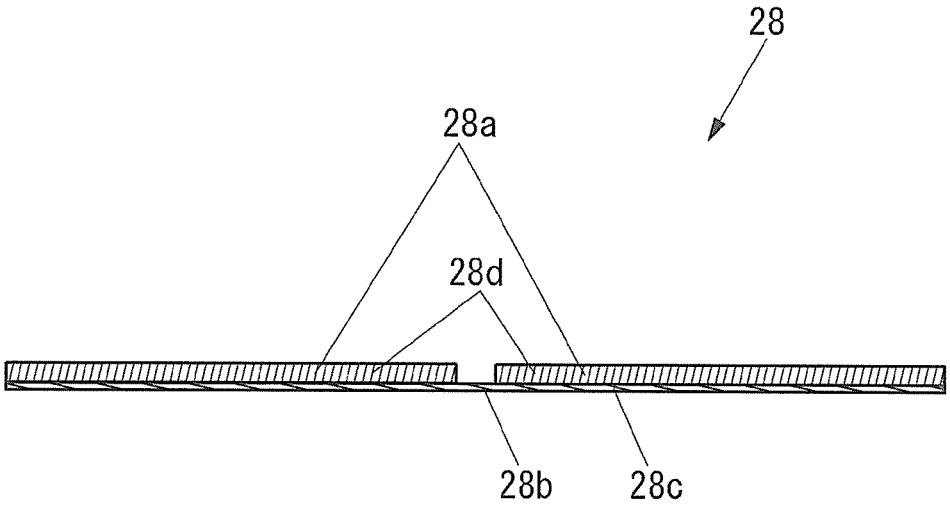
FIG. 6 is a cross sectional diagram of a part of a bellows unit shown in FIG. 3.
Figure 7:
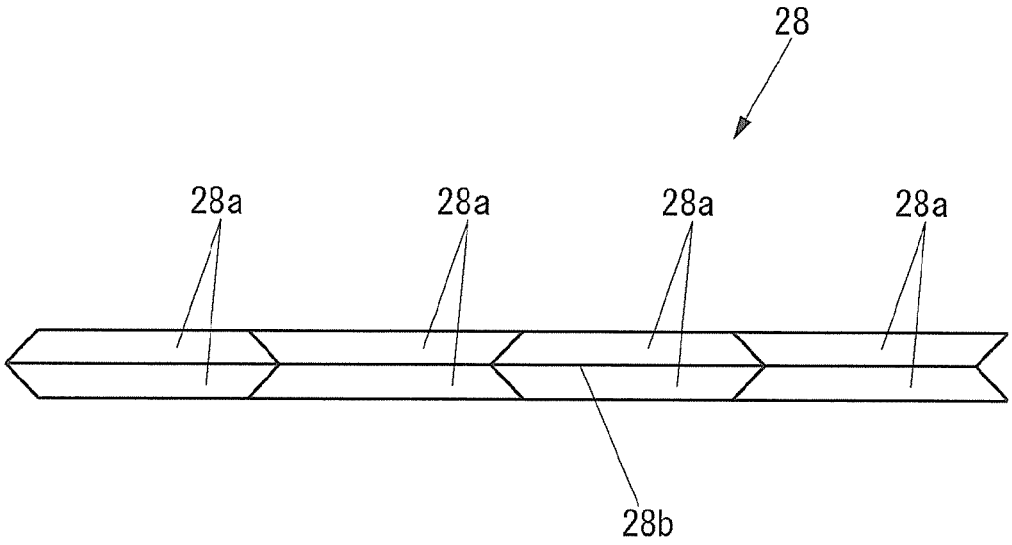
FIG. 7 is an expanded diagram of the bellows unit shown in FIG. 3.

FIG. 6 is a cross sectional diagram of a part of the bellows unit 28. FIG. 7 is an expanded diagram of the bellows unit 28.

As shown in FIG. 6 and FIG. 7, the bellows unit 28 includes eight plates 28*a*, and a bendable connecting unit 28*b* that connects the plates 28*a* and is bendable. The plates 28*a* are formed by overlays of a flexible film member 28*c* and plate-shaped members 28*d* fixed on the film member 28*c* by an adhesive. The bendable connecting unit 28*b* is formed by the film member 28*c*. The plate-shaped members 28*d* are formed by synthetic resin such as polyethylene. The plate-shaped members 28*d* do not have flexibility. A shape of the plate-shaped members 28*d* is trapezoidal.

It should be noted that, the plate-shaped members 28*d* (see FIG. 6) forming the two plates 28*a* on the right end in FIG. 7 and the plate-shaped members 28*d* (see FIG. 6) forming the two plates 28*a* on the left end in FIG. 7 are connected to each other via a flexible film member that is fixed to themselves by an adhesive, and which is not shown. That is, the plate-shaped members 28*d* forming the two plates 28*a* on the right end and the plate-shaped members 28*d* forming the two plates 28*a* on the left end are bendably connected to each other via this film member. As this film member, a part of the film member 28*c* (see FIG. 6) may alternatively be used.

The case 21 and the bellows unit 28 shown in FIG. 5 are connected to each other through a flexible film member that is fixed to themselves by an adhesive, and which is not shown. That is, the bellows unit 28 is connected bendably to the case 21 via this film member. As this film member, a part of the film member 28*c* of the bellows unit 28 (see FIG. 6) may alternatively be used.

The pressure receiving plate 26 and the bellows unit 28 shown in FIG. 5 are connected to each other via a flexible film member that is fixed to themselves by an adhesive, and which is not shown. That is, the bellows unit 28 is connected bendably to the pressure receiving plate 26 via this film member. As this film member, a part of the film member 28*c* of the bellows unit 28 (see FIG. 6) may alternatively be used.

Next, a manufacturing method of the damper device 20 will be described.

Firstly, after the O-ring 25 is fixed to the case 21, the rod member 27 is inserted into the hole 21*a* of the case 21, and the spring 24 is fixed to the valve 23.

Then, the cover 22 is fixed to the case 21 by an adhesive. Accordingly, the spring 24 is fixed to the cover 22 and the valve 23.

Finally, the bellows unit 28 is fixed to the case 21 and the pressure receiving plate 26 by an adhesive.

Next, an operation of the damper device 20 will be described.

When the recording head 11*c* discharges the ink 10*c*, an amount of the ink 10*c* in the head-side chamber 20*a* of the damper device 20 decreases. When the amount of the ink 10*c* in the head-side chamber 20*a* decreases, a volume of the head-side chamber 20*a* decreases, whereby the pressure receiving plate 26 moves in a direction shown by an arrow 20*g* accompanying contraction of the bellows unit 28. Here, if the pressure receiving plate 26 is making contact with the rod member 27, the valve 23 cannot move in the direction shown by the arrow 20*g* if a sum of force received from the pressure receiving plate 26 through the rod member 27 and force received by pressure of the ink 10*c* on a communicating passage 20*e* side is equal to or less than a sum of force received from the spring 24 and force received by pressure of the ink 10*c* on a tank-side chamber 20*c* side. If the valve 23 cannot move in the direction shown by the arrow 20*g*, the pressure receiving plate 26 connected to the valve 23 via the rod member 27 also cannot move in the direction shown by the arrow 20*g*. If the pressure receiving plate 26 cannot move in the direction shown by the arrow 20*g*, since the ink 10*c* in the head-side chamber 20*a* decreases in amount while the volume of the head-side chamber 20*a* is constant, the pressure drops.

When the pressure of the ink 10*c* in the head-side chamber 20*a* drops, force by which the pressure receiving plate 26, which is receiving the pressure of the ink 10*c* of the head-side chamber 20*a* and the air pressure, pushes the valve 23 via the rod member 27 is increased.

The valve 23 moves in the direction shown by the arrow 20*g* when the sum of the force received from the pressure receiving plate 26 through the rod member 27 and the force received by the pressure of the ink 10*c* on the communicating passage 20*e* side becomes larger than the sum of the force received from the spring 24 and the force received by the pressure of the ink 10*c* of the tank-side chamber 20*c*. That is, the valve 23 opens the communicating passage 20*e*. At this occasion, the pressure receiving plate 26 that is pushing the valve 23 in the direction shown by the arrow 20*g* through the rod member 27 moves in the direction shown by the arrow 20*g* accompanying the movement of the valve 23 in the direction shown by the arrow 20*g*. Further, the bellows unit 28 compresses accompanying the movement of the pressure receiving plate 26 in the direction shown by the arrow 20*g*.

Figure 8:
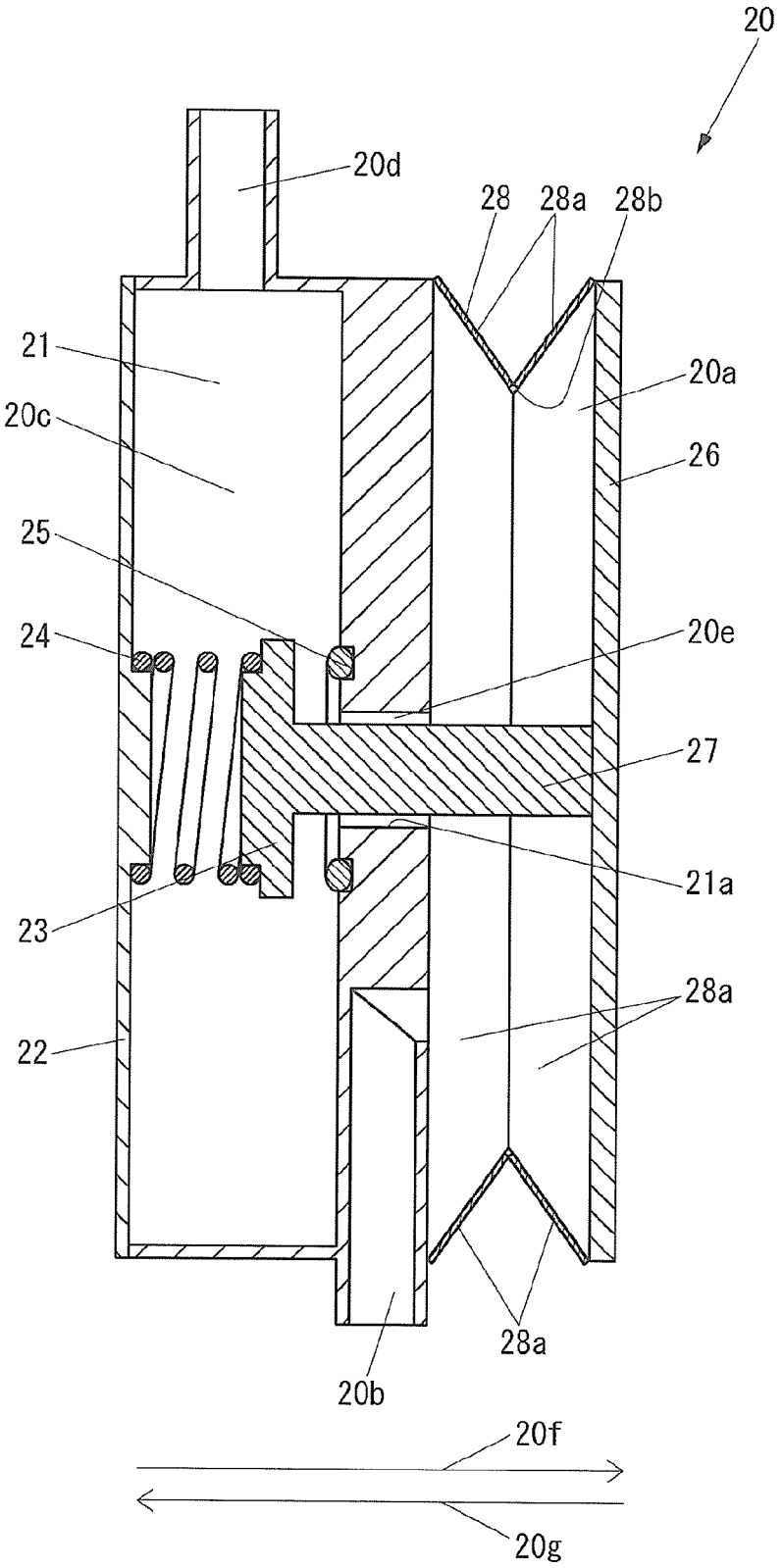
FIG. 8 is a front side cross sectional diagram of the damper device shown in FIG. 2 in the situation where the valve is opening the communicating passage.

Accordingly, the damper device 20 changes from a state shown in FIG. 3 to a state shown in FIG. 8.

FIG. 8 is a front side cross sectional diagram of the damper device 20 in the situation where the valve 23 is opening the communicating passage 20*e*.

The ink 10*c* in the tank-side chamber 20*c* is receiving high pressure by the tank 13 being at a higher position than the tank-side chamber 20*c*, thus when the damper device 20 comes to be in the state shown in FIG. 8, it passes through the communicating passage 20*e* and is guided into the head-side chamber 20*a*.

When the ink 10*c* is guided from the tank-side chamber 20*c* into the head-side chamber 20*a*, the amount of the ink 10*c* in the head-side chamber 20*a* increases. When the amount of the ink 10*c* in the head-side chamber 20*a* is increased, the volume of the head-side chamber 20*a* is increased, whereby the pressure receiving plate 26 moves in a direction shown by an arrow 20*f* accompanying the expansion of the bellows unit 28.

When the pressure receiving plate 26 moves in the direction shown by the arrow 20*f*, the valve 23 that is pressed against the pressure receiving plate 26 via the rod member 27 by the biasing force of the spring 24 moves in the direction shown by the arrow 20*f* accompanying the movement of the pressure receiving plate 26 in the direction shown by the arrow 20*f*. That is, the valve 23 closes the communicating passage 20*e*.

Accordingly, the damper device 20 changes from the state shown in FIG. 8 back to the state shown in FIG. 3.

As described above, since the damper device 20 changes the position of the pressure receiving plate 26 by the folding deformation of the bellows unit 28 instead of changing the position of the pressure receiving plate 26 by the deformation of the flexible film member itself as had conventionally been necessary, the conventional flexible film member that extends in a direction that is vertical to the direction of the arrow 20*f* or the arrow 20*g* along which the valve 23 opens or closes the communicating passage 20*e* and supports the pressure receiving plate 26 so that the position of the pressure receiving plate 26 is changeable is no longer necessary. Accordingly, the damper device 20 can make its size in the direction that is vertical to the direction shown by the arrow 20*f* or the arrow 20*g* smaller than the conventional configuration.

It should be noted that, since the damper device 20 does not require the conventional flexible film member that extends in the direction that is vertical to the direction shown by the arrow 20*f* or the arrow 20*g* and supports the pressure receiving plate 26 so that the position of the pressure receiving plate 26 is changeable, an area of the pressure receiving plate 26 in the direction that is vertical to the direction shown by the arrow 20*f* or the arrow 20*g* can be made larger than the conventional configuration. Accordingly, the damper device 20 can easily receive the force needed for the valve 23 to open the communicating passage 20*e* by the air pressure using the pressure receiving plate 26.

Figure 9:
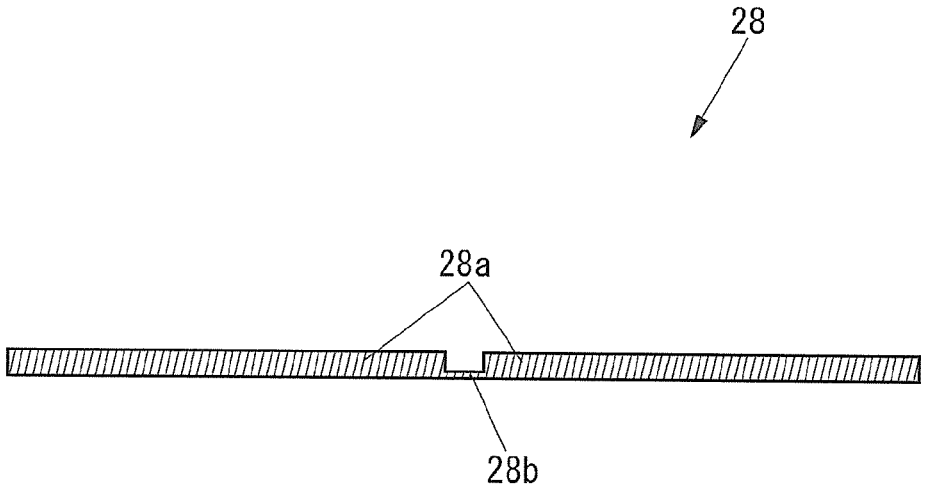
FIG. 9 is a cross sectional diagram of a part of the bellows unit shown in FIG. 3, and is a diagram showing a different example from the example shown in FIG. 6.

FIG. 9 is a cross sectional diagram of a part of the bellows unit 28, and is a diagram showing a different example from the example shown in FIG. 6.

The bellows unit 28 described as above has a structure shown in FIG. 6. However, the bellows unit 28 may have a structure shown in FIG. 9. In FIG. 9, the bellows unit 28 is formed by having the plates 28*a* and the bendable connecting unit 28*b* connecting the plates 28*a* and being bendable formed as one component made of synthetic resin such as polyethylene. In FIG. 9, the bendable connecting unit 28*b* is formed thinner compared to the plates 28*a* so as to be bendable.

If the bellows unit 28 has the structure shown in FIG. 9, the damper device 20 can have the plates 28*a* and the bendable connecting unit 28*b* manufactured by integral formation of synthetic resin. Accordingly, if the bellows unit 28 has the structure shown in FIG. 9, the damper device 20 can reduce for example manufacturing cost compared to the case where the bellows unit 28 has the structure shown in FIG. 6.

Figure 10:
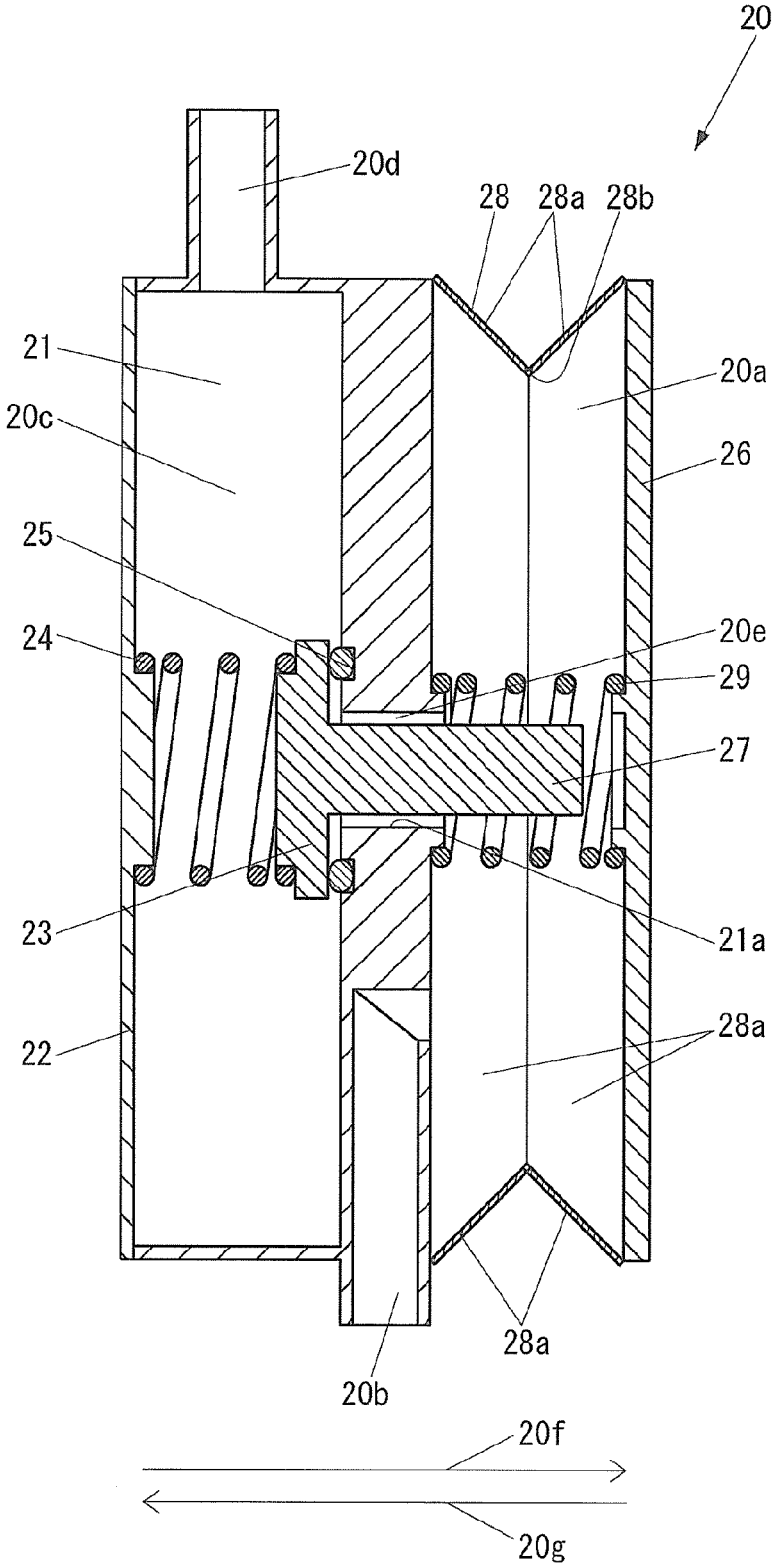
FIG. 10 is a front side cross sectional diagram of the damper device shown in FIG. 2 in the situation where the valve is closing the communicating passage, and is a diagram showing a different example from the example shown in FIG. 3.

FIG. 10 is a front side cross sectional diagram of the damper device 20 in the situation where the valve 23 is closing the communicating passage 20*e*, and is a diagram showing a different example from the example shown in FIG. 3.

As shown in FIG. 10, the damper device 20 may provide a spring 29 between the case 21 and the pressure receiving plate 26. In case of having the structure shown in FIG. 10, the damper device 20 can surely maintain the pressure of the ink 10*c* of the head-side chamber 20*a* to be a negative pressure relative to the air pressure.

Figure 11:
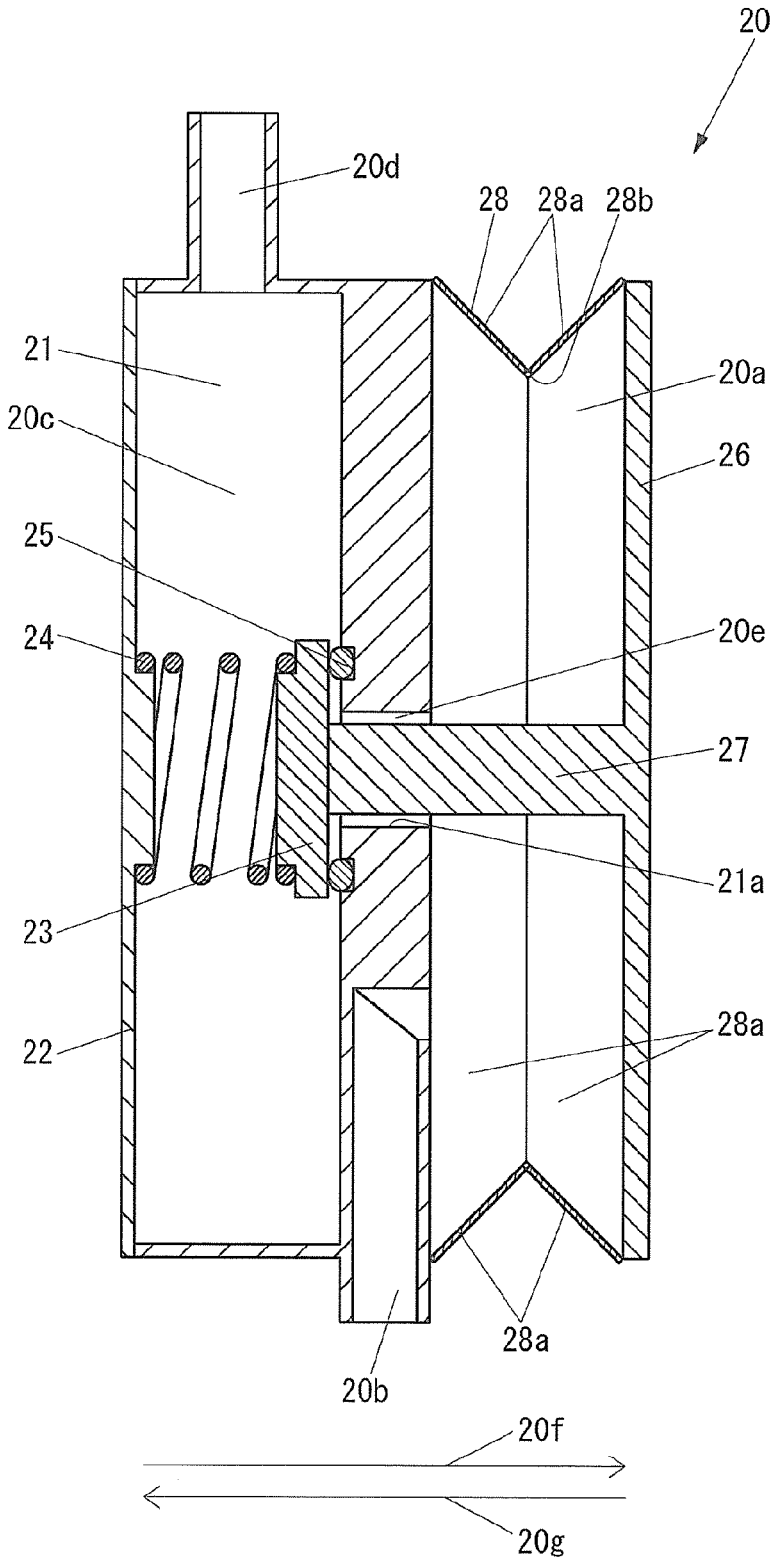
FIG. 11 is a front side cross sectional diagram of the damper device shown in FIG. 2 in the situation where the valve is closing the communicating passage, and is a diagram showing a different example from the examples shown in FIG. 3 and FIG. 10.

FIG. 11 is a front side cross sectional diagram of the damper device 20 in the situation where the valve 23 is closing the communicating passage 20*e*, and is a diagram showing a different example from the examples shown in FIG. 3 and FIG. 10.

The rod member 27 described as above is formed as one component made of synthetic resin such as polyethylene together with the valve 23. However, as shown in FIG. 11, the rod member 27 may be formed as one component made of synthetic resin such as polyethylene together with the pressure receiving plate 26.

Second Embodiment

Firstly, a configuration of an inkjet printer according to the present embodiment will be described.

It should be noted that, among the configurations in the inkjet printer according to the present embodiment, those similar to the configurations of the inkjet printer 10 according to the first embodiment (see FIG. 1) will be given the same reference signs as the configuration of the inkjet printer 10, and detailed descriptions thereof will be omitted.

Figure 12:
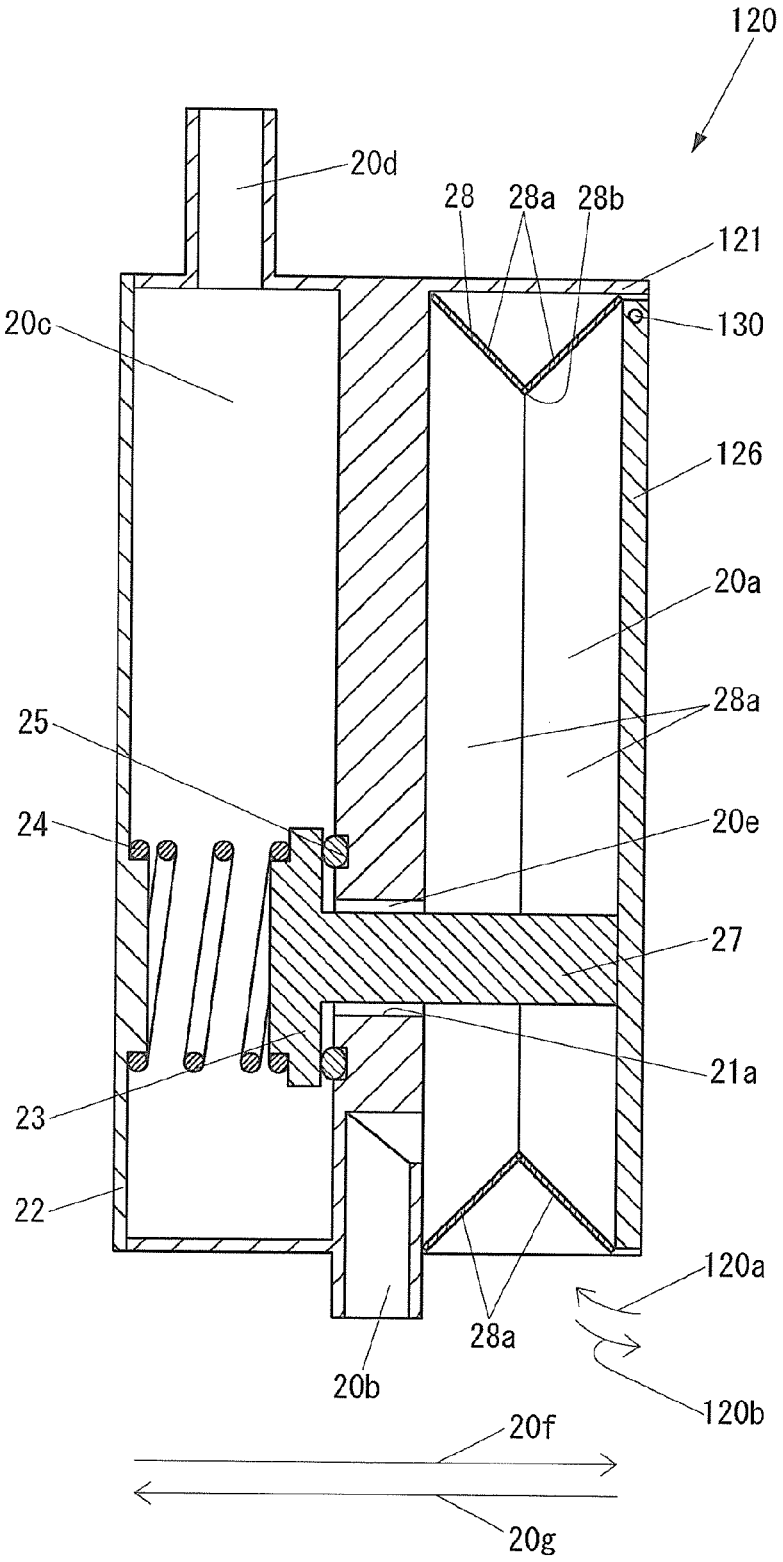
FIG. 12 is a front side cross sectional diagram of a damper device of an inkjet printer according to a second embodiment of the present invention in the situation where a valve is closing a communicating passage.
Figure 13:
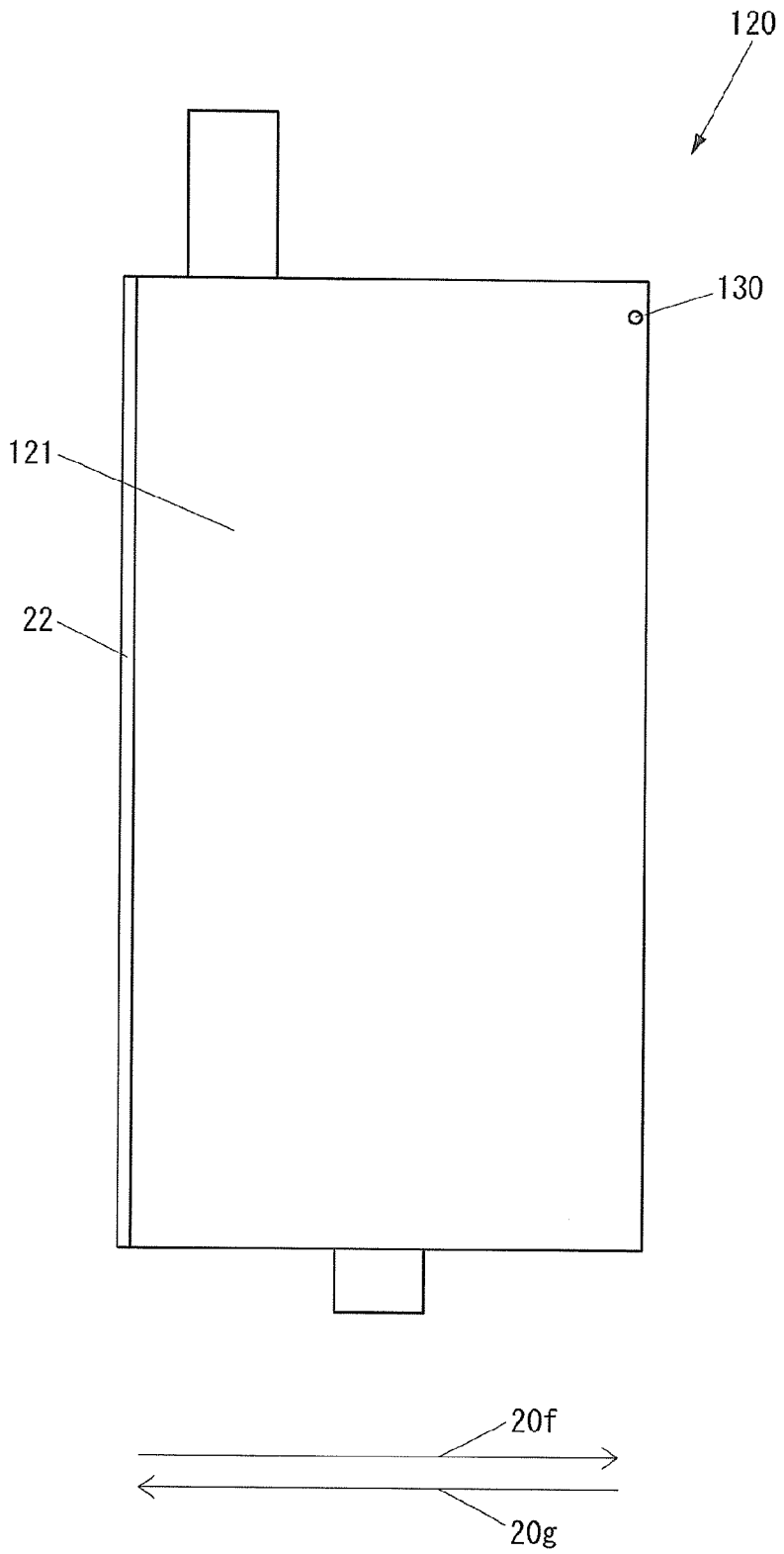
FIG. 13 is a front side diagram of the damper device shown in FIG. 12.
Figure 14:
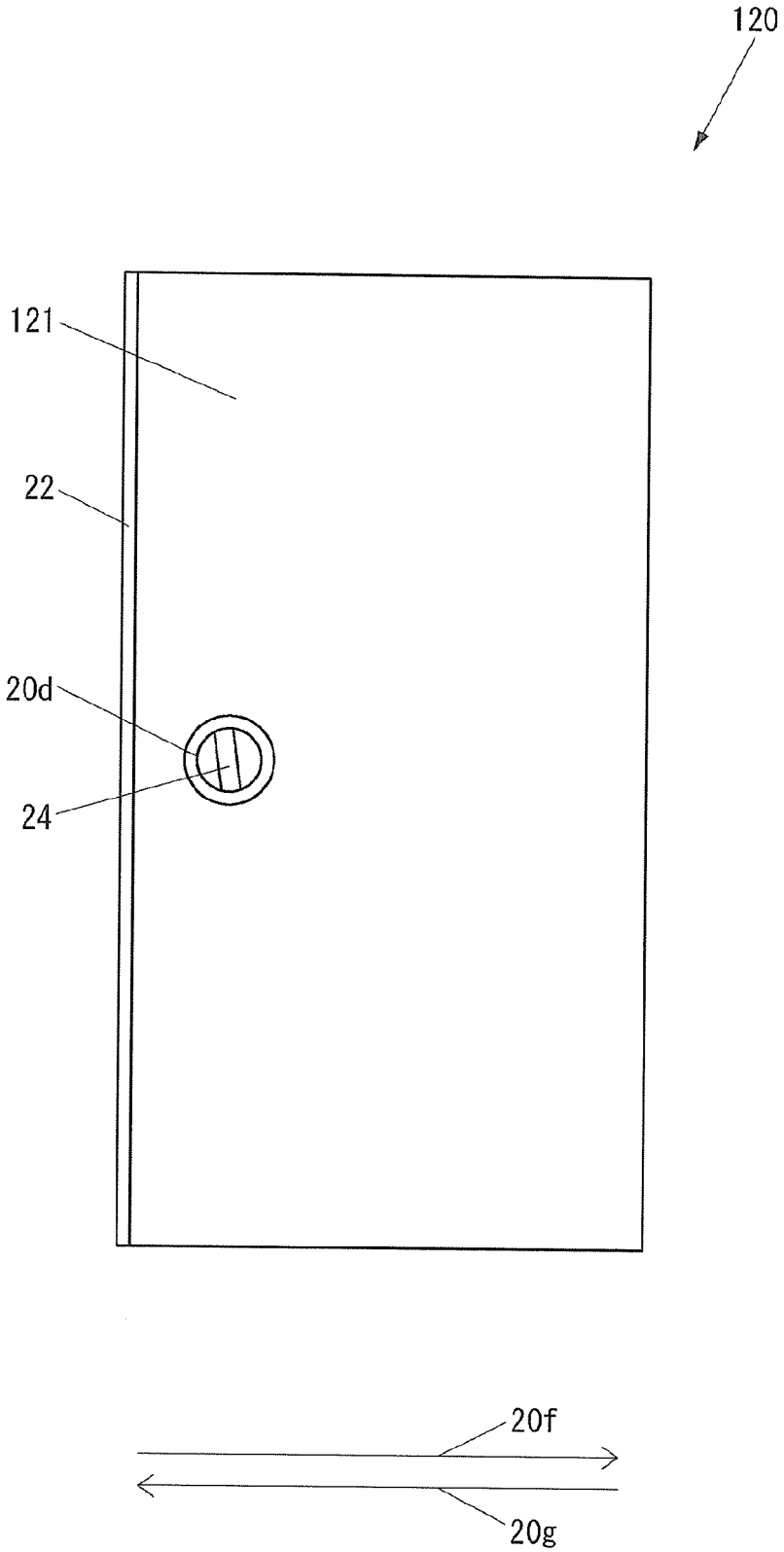
FIG. 14 is a planar diagram of the damper device shown in FIG. 12.

FIG. 12 is a front side cross sectional diagram of a damper device 120 of the inkjet printer according to the present embodiment in the situation where the valve 23 closes the communicating passage 20*e*. FIG. 13 is a front side diagram of the damper device 120. FIG. 14 is a planar diagram of the damper device 120.

A configuration of the inkjet printer according to the present embodiment is similar to a configuration in which the inkjet printer 10 (see FIG. 1) includes the damper device 120 shown in FIG. 12 to FIG. 14 instead of the damper device 20 (see FIG. 3).

Compared to the damper device 20, the damper device 120 includes a case 121 in which a passage 20*b* and a passage 20*d* are formed, and a pressure receiving plate 126 as the pressure receiving unit that receives the air pressure and changes the volume of the head-side chamber 20*a* according to a change in the position of itself, instead of the case 21 (see FIG. 3) and the pressure receiving plate 26 (see FIG. 3). Further, the damper device 120 includes a shaft 130 that rotatably supports the pressure receiving plate 126.

The head-side chamber 20*a* is formed by the case 121, the pressure receiving plate 126 and the bellows unit 28.

The case 121 is formed by synthetic resin such as polyethylene. The case 121 has the cover 22 fixed by an adhesive.

The pressure receiving plate 126 is formed by synthetic resin such as polyethylene. The pressure receiving plate 126 does not have flexibility.

The shaft 130 is supported by the case 121. The shaft 130 extends in the direction that is vertical to the direction shown by the arrow 20*f* or the arrow 20*g*.

Next, a manufacturing method of the damper device 120 will be described.

Firstly, after the o-ring 25 is fixed to the case 121, the rod member 27 is inserted into the hole 21*a* of the case 121, and the spring 24 is fixed to the valve 23.

Then, the cover 22 is fixed to the case 121 by an adhesive. Accordingly, the spring 24 is fixed to the cover 22 and the valve 23.

Then, the bellows unit 28 is fixed to the case 121 and the pressure receiving plate 126 by an adhesive.

Finally, the shaft 130 is fixed to the case 121 by an adhesive in a state where the shaft 130 is inserted into a hole of the case 121 and a hole of the pressure receiving plate 126.

Next, an operation of the damper device 120 will be described.

When the recording head 11*c* discharges the ink 10*c*, the amount of the ink 10*c* in the head-side chamber 20*a* of the damper device 120 decreases. When the amount of the ink 10*c* in the head-side chamber 20*a* decreases, the volume of the head-side chamber 20*a* decreases, whereby the pressure receiving plate 126 rotates in a direction shown by an arrow 120*a* with the shaft 130 as a center, accompanying contraction of the bellows unit 28. Here, if the pressure receiving plate 126 is making contact with the rod member 27, the valve 23 cannot move in the direction shown by the arrow 20*g* if a sum of force received from the pressure receiving plate 126 through the rod member 27 and force received by pressure of the ink 10*c* on the communicating passage 20*e* side is equal to or less than the sum of force received from the spring 24 and force received by pressure of the ink 10*c* on the tank-side chamber 20*c*. If the valve 23 cannot move in the direction shown by the arrow 20*g*, the pressure receiving plate 126 connected to the valve 23 through the rod member 27 also cannot rotate in the direction shown by the arrow 120*a* with the shaft 130 as the center. If the pressure receiving plate 126 cannot rotate in the direction shown by the arrow 120*a* with the shaft 130 as the center, since the ink 10*c* in the head-side chamber 20*a* decreases in amount while the volume of the head-side chamber 20*a* is constant, the pressure drops.

When the pressure of the ink 10*c* in the head-side chamber 20*a* drops, the force by which the pressure receiving plate 126, which is receiving the pressure of the ink 10*c* of the head-side chamber 20*a* and the air pressure, pushes the valve 23 via the rod member 27 is increased.

The valve 23 moves in the direction shown by the arrow 20*g* when the sum of the force received from the pressure receiving plate 126 through the rod member 27 and the force received by the pressure of the ink 10*c* on the communicating passage 20*e* side becomes larger than the sum of the force received from the spring 24 and the force received by the pressure of the ink 10*c* of the tank-side chamber 20*c*. That is, the valve 23 opens the communicating passage 20*e*. At this occasion, the pressure receiving plate 126 that is pushing the valve 23 in the direction shown by the arrow 20*g* through the rod member 27 rotates in the direction shown by the arrow 120*a* with the shaft 130 as the center, accompanying the movement of the valve 23 in the direction shown by the arrow 20*g*. Further, the bellows unit 28 compresses accompanying the rotation of the pressure receiving plate 126 in the direction shown by the arrow 120*a* with the shaft 130 as the center.

Figure 15:
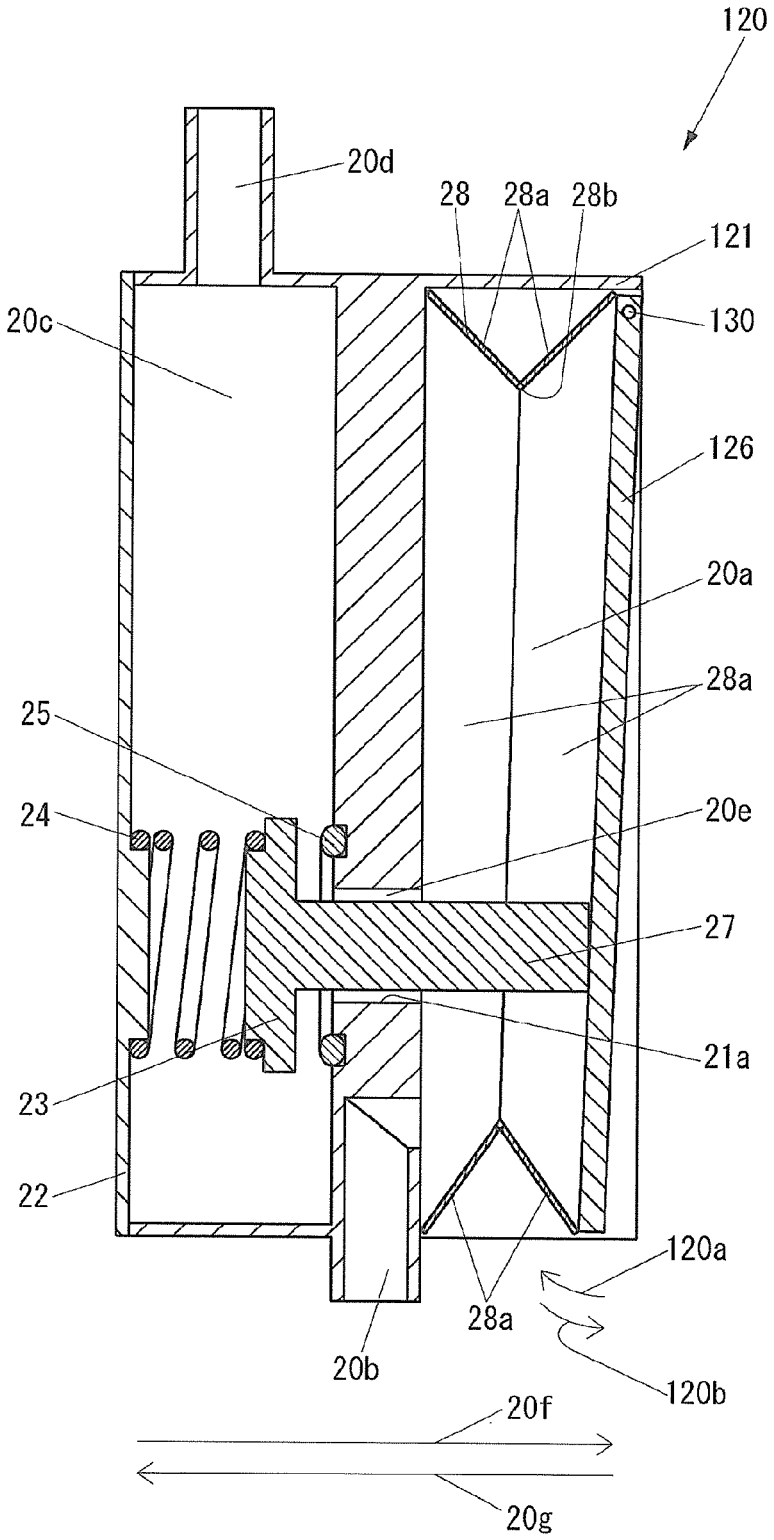
FIG. 15 is a front side cross sectional diagram of the damper device shown in FIG. 12 in the situation where the valve is opening the communicating passage.

Accordingly, the damper device 120 changes from a state shown in FIG. 12 to a state shown in FIG. 15.

FIG. 15 is a front side cross sectional diagram of the damper device 120 in the situation where the valve 23 is opening the communicating passage 20*e*.

The ink 10*c* in the tank-side chamber 20*c* is receiving high pressure by the tank 13 being at a higher position than the tank-side chamber 20*c*, thus when the damper device 120 comes to be in the state shown in FIG. 15, it passes through the communicating passage 20*e* and is guided into the head-side chamber 20*a*.

When the ink 10*c* is guided from the tank-side chamber 20*c* into the head-side chamber 20*a*, the amount of the ink 10*c* in the head-side chamber 20*a* increases. When the amount of the ink 10*c* in the head-side chamber 20*a* increases, the volume of the head-side chamber 20*a* increases, whereby the pressure receiving plate 126 rotates in the direction shown by an arrow 120*b* with the shaft 130 as the center, accompanying expansion of the bellows unit 28.

When the pressure receiving plate 126 rotates in the direction shown by the arrow 120*b* with the shaft 130 as the center, the valve 23 that is pressed against the pressure receiving plate 126 via the rod member 27 by the biasing force of the spring 24 moves in the direction shown by the arrow 20*f* accompanying the rotation of the pressure receiving plate 126 in the direction shown by the arrow 120*b* with the shaft 130 as the center. That is, the valve 23 closes the communicating passage 20*e*.

Accordingly, the damper device 120 changes from the state shown in FIG. 15 back to the state shown in FIG. 12.

As described above, since the damper device 120 changes the position of the pressure receiving plate 126 by the folding deformation of the bellows unit 28 instead of changing the position of the pressure receiving plate 126 by the deformation of the flexible film member itself as had conventionally been necessary, the conventional flexible film member that extends in the direction that is vertical to the direction shown by the arrow 20*f* or the arrow 20*g* and supports the pressure receiving plate 126 so that the position of the pressure receiving plate 126 is changeable is no longer necessary. Accordingly, the damper device 120 can make its size in the direction that is vertical to the direction shown by the arrow 20*f* or the arrow 20*g* smaller than the conventional configuration.

It should be noted that, since the damper device 120 does not require the conventional flexible film member that extends in the direction that is vertical to the direction shown by the arrow 20*f* or the arrow 20*g* and supports the pressure receiving plate 126 so that the position of the pressure receiving plate 126 is changeable, the area of the pressure receiving plate 126 in the direction that is vertical to the direction shown by the arrow 20*f* or the arrow 20*g* can be made larger than the conventional configuration. Accordingly, the damper device 120 can easily receive the force needed for the valve 23 to open the communicating passage 20*e* by the air pressure using the pressure receiving plate 126.

Since the damper device 120 has the pressure receiving plate 126 rotatably supported, in the situation where the valve 23 is to transmit force to the pressure receiving plate 126 through the rod member 27 at a distant position from the shaft 130 being the rotation center of the pressure receiving plate 126 as shown in FIG. 12, a moving amount of the valve 23 relative to a decreased amount of the ink 10*c* in the head-side chamber 20*a* can be increased, compared to the configuration in which the entirety of the pressure receiving plate 126 moves in the direction shown by the arrow 20*f* or the arrow 20*g* as in the damper device 20 according to the first embodiment. Accordingly, the damper device 120 can reduce the pressure fluctuation of the ink 10*c* in the head-side chamber 20*a*, as a result of which discharging accuracy of the ink 10*c* by the recording head 11*c* can be stabilized.

Figure 16:
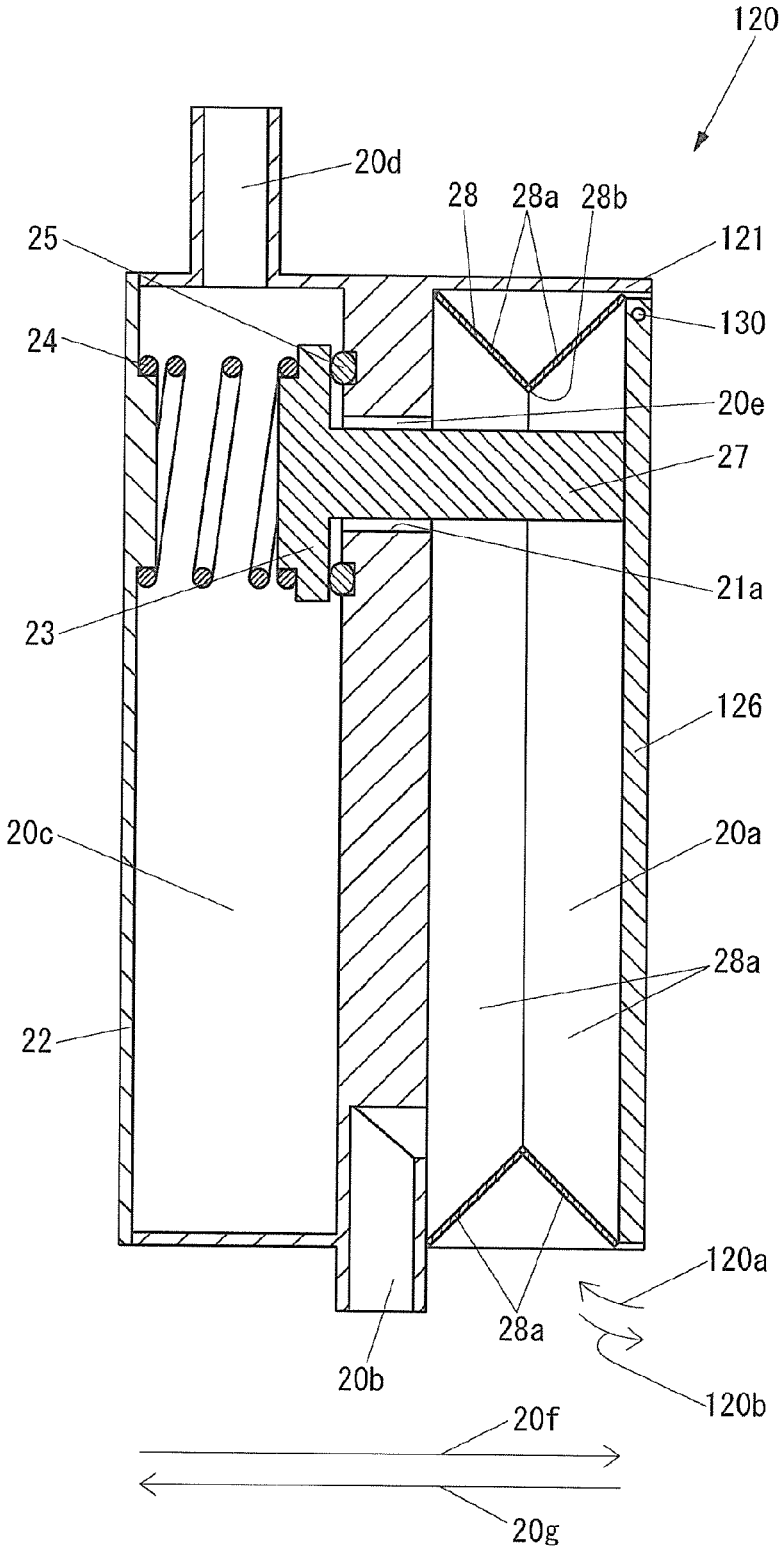
FIG. 16 is a front side cross sectional diagram of the damper device of the inkjet printer according to the second embodiment of the present invention in the situation where the valve is closing the communicating passage, and is a diagram showing a different example from the example shown in FIG. 12.

FIG. 16 is a front side cross sectional diagram of the damper device 120 of the inkjet printer according to the present embodiment in the situation where the valve 23 is closing the communicating passage 20*e*, and is a diagram showing a different example from the example shown in FIG. 12.

Since the damper device 120 shown in FIG. 16 has the rod member 27 making contact with the pressure receiving plate 126 in the vicinity of the shaft 130, the force by which the pressure receiving plate 126 pushes the rod member 27 becomes large even if the force that the pressure receiving plate 126 receives from the air pressure is small, due to a principle of leverage. That is, since the damper device 120 has the pressure receiving plate 126 rotatably supported, when the valve 23 is to transmit force to the pressure receiving plate 126 through the rod member 27 in the vicinity of the shaft 130 being the rotation center of the pressure receiving plate 126 as shown in FIG. 16, the pressure receiving plate 126 can obtain the force needed for the valve 23 to open the communicating passage 20*e* from the air pressure even if the size of the pressure receiving plate 126 in the direction that is vertical to the direction shown by the arrow 20*f* or the arrow 20*g* is made compact, as compared to the configuration in which the entirety of the pressure receiving plate 126 moves in the direction shown by the arrow 20*f* or the arrow 20*g*.

Figure 17:
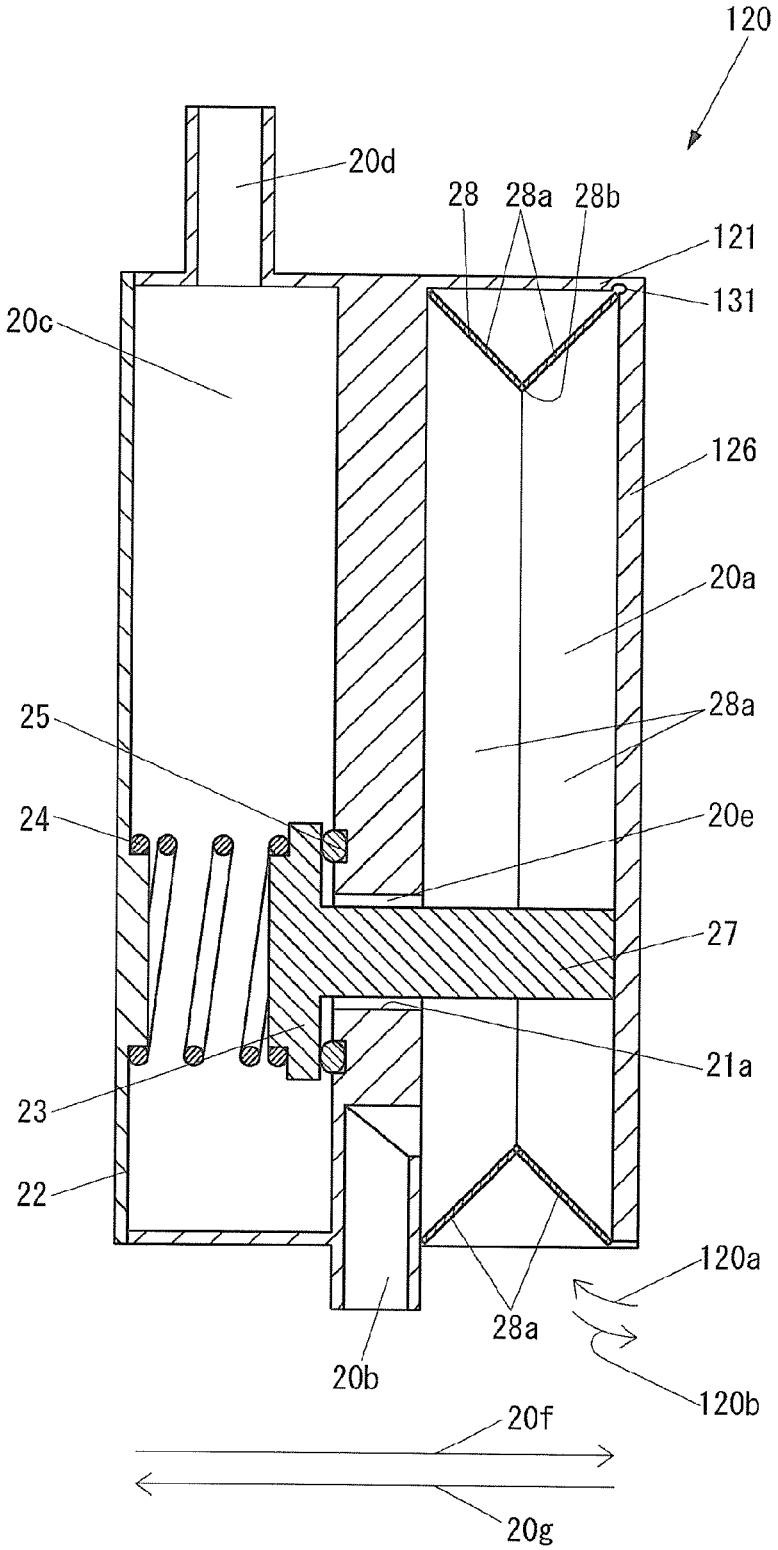
FIG. 17 is a front side cross sectional diagram of the damper device of the inkjet printer according to the second embodiment of the present invention in the situation where the valve is closing the communicating passage, and is a diagram showing a different example from the examples shown in FIG. 12 and FIG. 16.

FIG. 17 is a front side cross sectional diagram of the damper device 120 of the inkjet printer according to the present embodiment in the situation where the valve 23 is closing the communicating passage 20*e*, and is a diagram showing a different example from the examples shown in FIG. 12 and FIG. 16.

In the damper device 120 shown in FIG. 17, the pressure receiving plate 126 and the case 121 being a supporting unit that rotatably supports the pressure receiving plate 126 are formed as one component formed of synthetic resin such as polyethylene. A portion 131 that enables the pressure receiving plate 126 to be rotatable relative to the case 121 in FIG. 17 is formed thin compared to the case 121 and the pressure receiving plate 126.

If the damper device 120 has the structure shown in FIG. 17, the case 121 and the pressure receiving plate 126 can be manufactured by integral formation of synthetic resin. Accordingly, if the damper device 120 has the structure shown in FIG. 17, for example the manufacturing cost can be reduced compared to the case of the structure shown in FIG. 12.

Figure 18:
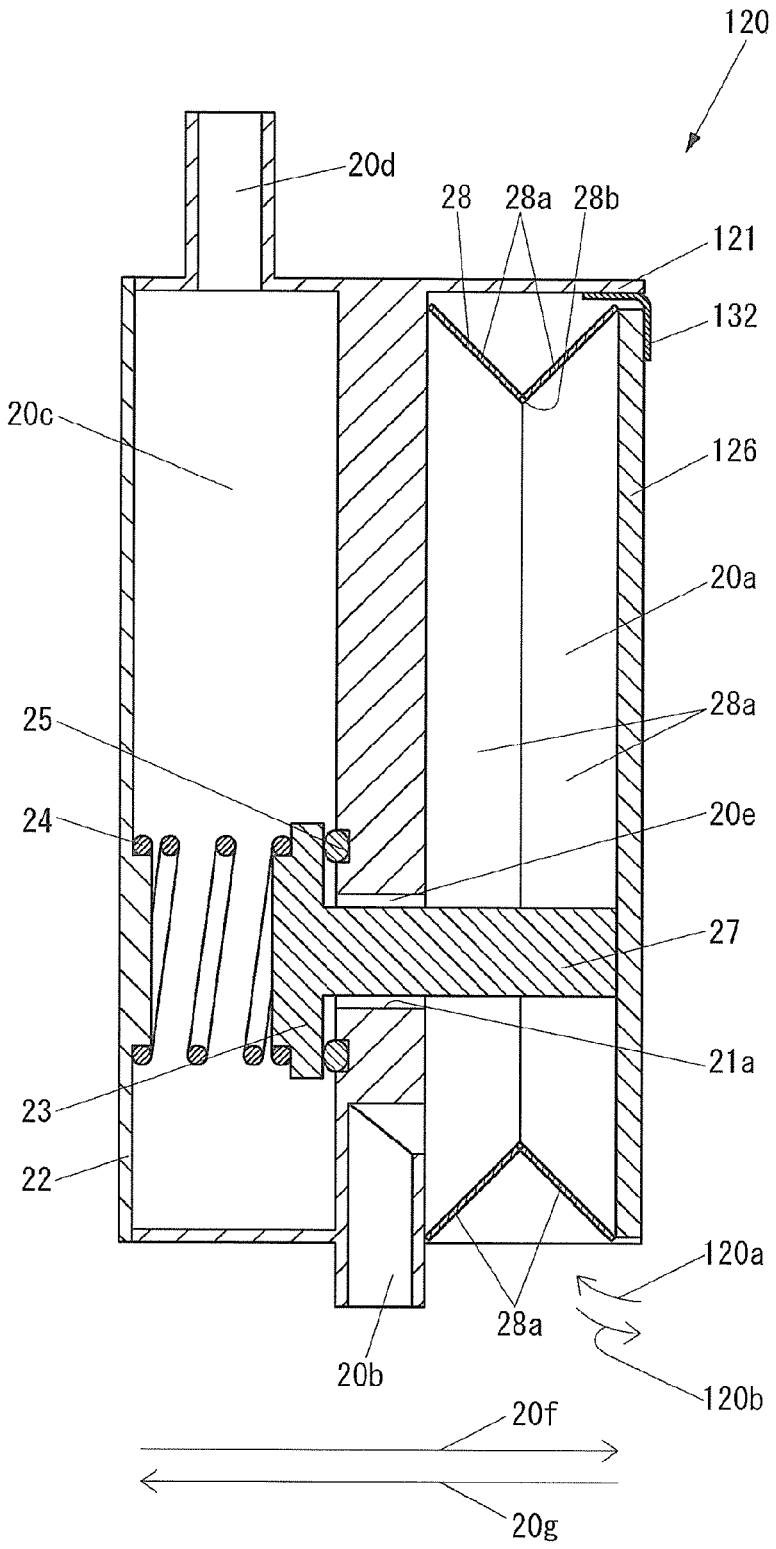
FIG. 18 is a front side cross sectional diagram of the damper device of the inkjet printer according to the second embodiment of the present invention in the situation where the valve is closing the communicating passage, and is a diagram showing a different example from the examples shown in FIG. 12, FIG. 16, and FIG. 17.

FIG. 18 is a front side cross sectional diagram of the damper device 120 of the inkjet printer according to the present embodiment in the situation where the valve 23 is closing the communicating passage 20*e*, and is a diagram showing a different example from the examples shown in FIG. 12, FIG. 16, and FIG. 17.

In the damper device 120 shown in FIG. 18, the case 121 and the pressure receiving plate 126 are connected to each other via a flexible film member 132 that is fixed to themselves by an adhesive. That is, the pressure receiving plate 126 is supported rotatably by the case 121 via the film member 132.

The invention claimed is:

1. A damper device provided in an inkjet printer including a recording head that discharges ink, and a tank that supplies the ink, and the damper device being configured to supply the ink supplied from the tank to the recording head while suppressing pressure fluctuation, and the damper device comprising:

a head-side chamber that communicates with the recording head;

a tank-side chamber that communicates with the tank;

a communicating passage that communicates the head-side chamber and the tank-side chamber;

a valve, being configured to open or close the communicating passage;

a biasing member that biases the valve in a direction along which the valve closes the communicating passage;

a pressure receiving unit that receives air pressure, and changes volume of the head-side chamber according to a change in a position of the pressure receiving unit;

a force transmitting unit that is arranged between the valve and the pressure receiving unit, and configured to transmit force received from one of the valve and the pressure receiving unit to the other of the valve and the pressure receiving unit; and a bellows unit that supports the pressure receiving unit so that the position of the pressure receiving unit is changeable, wherein the bellow unit has a folding deformation structure, and the position of the pressure receiving unit is changed by a folding deformation of the folding deformation structure.

2. The damper device according to claim 1, wherein the bellows unit includes: a plurality of plates, and a bendable connecting unit that connects the plates, and the plates and the bendable connecting unit are formed as one component made of synthetic resin.

3. The damper device according to claim 1, wherein the pressure receiving unit is supported rotatably.

4. The damper device according to claim 3, wherein the pressure receiving unit and a supporting unit rotatably supporting the pressure receiving unit are formed as one component made of synthetic resin.

5. The damper device according to claim 2, wherein the pressure receiving unit is supported rotatably.

6. The damper device according to claim 5, wherein the pressure receiving unit and a supporting unit rotatably supporting the pressure receiving unit are formed as one component made of synthetic resin.

* * * * *